US009916969B2

(12) United States Patent
Jolliffe et al.

(10) Patent No.: US 9,916,969 B2
(45) Date of Patent: Mar. 13, 2018

(54) MASS ANALYSER INTERFACE

(71) Applicant: PERKINELMER HEALTH SCIENCES CANADA, INC., Woodbridge (CA)

(72) Inventors: Charles Jolliffe, Schomberg (CA); Lisa Cousins, Woodbridge (CA); Gholamreza Javahery, Kettleby (CA)

(73) Assignee: PerkinElmer Health Sciences Canada, Inc., Woodbridge, Ontario (CA)

( * ) Notice: Subject to any disclaimer, the term of this patent is extended or adjusted under 35 U.S.C. 154(b) by 0 days.

(21) Appl. No.: 13/740,985

(22) Filed: Jan. 14, 2013

(65) Prior Publication Data

US 2014/0197333 A1 Jul. 17, 2014

(51) Int. Cl.
*H01J 49/04* (2006.01)
*H01J 49/06* (2006.01)

(52) U.S. Cl.
CPC ..... *H01J 49/044* (2013.01); *H01J 49/062* (2013.01)

(58) Field of Classification Search
CPC ..... H01J 49/00; H01J 49/04
See application file for complete search history.

(56) References Cited

U.S. PATENT DOCUMENTS 4,746,794 A * 5/1988 French ..... H01J 49/04 250/281
5,338,931 A * 8/1994 Spangler et al. ..... 250/287
5,770,857 A * 6/1998 Fuerstenau ..... H01J 49/027 250/281
6,630,662 B1 * 10/2003 Loboda ..... H01J 49/063 250/281
7,932,488 B2 4/2011 Javahery et al.
2002/0185606 A1 * 12/2002 Smith ..... G01N 15/1456 250/341.7
2003/0136905 A1 * 7/2003 Franzen et al. ..... 250/292
2004/0079881 A1 * 4/2004 Fischer et al. ..... 250/288
2006/0076484 A1 * 4/2006 Brown et al. ..... 250/290
2009/0212210 A1 * 8/2009 Finlay ..... H01J 49/0404 250/288
2009/0218484 A1 * 9/2009 Javahery et al. ..... 250/282
2009/0294650 A1 * 12/2009 Schneider ..... G01N 27/624 250/282
2010/0282961 A1 * 11/2010 Miller et al. ..... 250/282
2011/0095175 A1 * 4/2011 Bateman ..... G01N 27/624 250/282
2012/0267548 A1 * 10/2012 Vidal-De-Miguel ..... H01J 49/0422 250/424
2012/0292526 A1 * 11/2012 Hiraoka et al. ..... 250/423 R
2012/0325024 A1 * 12/2012 Vidal-de-Miguel . G01N 27/622 73/863.24

OTHER PUBLICATIONS

Ashcroft et al., "Ionization Methods in Organic Mass Spectrometry", The Royal Society of Chemistry, UK, 1997.*
Kanu et al., "Ion mobility—mass spectrometry," 2008, Journal of Mass Spectrometry, J. Mass Spectrom, vol. 43, pp. 1-22.

* cited by examiner

*Primary Examiner* — Wyatt Stoffa
*Assistant Examiner* — James Choi

(57) ABSTRACT

A mass analyzer includes a desolvation chamber into which an upstream gas is injected to provide a counter-flow to said downstream flow in the chamber. The counter-flow may slow the downstream flow of solvated ionized particles in the chamber, while allowing lighter desolvated ions to travel toward an outlet aperture of the desolvation chamber.

32 Claims, 8 Drawing Sheets

MASS ANALYSER INTERFACE

FIELD OF THE INVENTION

The present invention relates in general to all analytical instruments and in particular to mass analysers and mass analyser interfaces that include a desolvation chamber(s) that provides a counter flow to aid in desolvation.

BACKGROUND OF THE INVENTION

Mass analysis, and more particularly mass spectrometry, has proven to be an effective analytical technique for identifying unknown compounds and for determining the precise mass of known compounds. Advantageously, compounds can be detected or analysed in minute quantities allowing compounds to be identified at very low concentrations in chemically complex mixtures. Not surprisingly, mass spectrometry has found practical application in medicine, pharmacology, food sciences, semi-conductor manufacturing, environmental sciences, security, and many other fields.

A typical mass spectrometer includes an ion source that ionizes particles of interest. The ions are passed to an analyser region, where they are separated according to their mass (m)-to-charge (z) ratios (m/z). The separated ions are detected at a detector. A signal from the detector may be sent to a computing or similar device where the m/z ratios may be stored together with their relative abundance for presentation in the format of a m/z spectrum.

Typical ion sources are detailed in "Ionization Methods in Organic Mass Spectrometry", Alison E. Ashcroft, The Royal Society of Chemistry, UK, 1997; and the references cited therein. Conventional ion sources may, for example, create ions by electrospray or chemical ionization.

Electrospray ionization involves dispersing liquid containing analyte(s) of interest into a fine aerosol jet of solvated charged droplets. Typically, a nebulizer gas flow is involved in this dispensing process and an impinging heater gas flow assists droplet desolvation. Charged droplets are drawn by an electric field to the sampling inlet of a mass spectrometer. Liquid flows greater than 25 μL/m usually require the various gas flows to be heated for rapid desolvation.

Atmospheric pressure chemical ionization ("APCI") relies on liquid containing analyte of interest to be discharged into a fine aerosol jet of droplets containing the analyte. Again, a nebulizer gas flow is involved and an impinging heater gas flow may assist droplet desolvation. Desolvated analyte molecules are chemically ionized by reagent ions created in close proximity by a corona current.

It has long been recognized that the sampling inlet is a major sensitivity bottleneck: typical diameters of the sampling inlet are about 0.5 mm, and space repulsion of analyte ions acts as a choke upon significant sensitivity increases. Although larger sampling diameters are desired for higher sensitivity, such apertures necessitate larger vacuum pumps. Present vacuum pumping systems are at their practical maximum in terms of size and cost.

Accordingly, alternative approaches are required.

SUMMARY OF THE INVENTION

Exemplary of an embodiment of the present invention, a mass analyzer includes a desolvation chamber into which an upstream gas is injected to provide a counter-flow to the downstream flow in the chamber. The counter flow may slow the downstream flow of solvated ionized particles in the chamber, while allowing lighter desolvated ions to travel toward an outlet aperture of the chamber. The chamber may be heated to aid in desolvation. Further, the chamber may be maintained at a low (below atmosphere) pressure.

In an embodiment, a mass analyser interface, includes a desolvation chamber having an inlet for receiving solvated analyte particles from a source of analyte particles, and an outlet aperture. An electric field source provides an electric field to urge ionized particles within the chamber from the inlet toward the outlet aperture, creating a downstream flow of ionized particles. A gas injection port injects an upstream gas proximate the outlet aperture, to provide a counter-flow to the downstream flow at the aperture, to slow the downstream flow as the ionized particles travel toward the outlet aperture. At least one evacuation port allows injected gas to escape from the desolvation chamber.

In another embodiment, a method of providing desolvated ions in a mass analyzer includes: providing solvated analyte particles from a source of analyte particles into a desolvation chamber having an inlet and an outlet aperture; providing an electric field to urge ionized particles toward the outlet aperture in a downstream flow; heating the desolvation chamber; and injecting an upstream gas proximate the outlet aperture, to provide a counter-flow to the downstream flow at the aperture, to slow the downstream flow and any solvated particles entrained therein.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
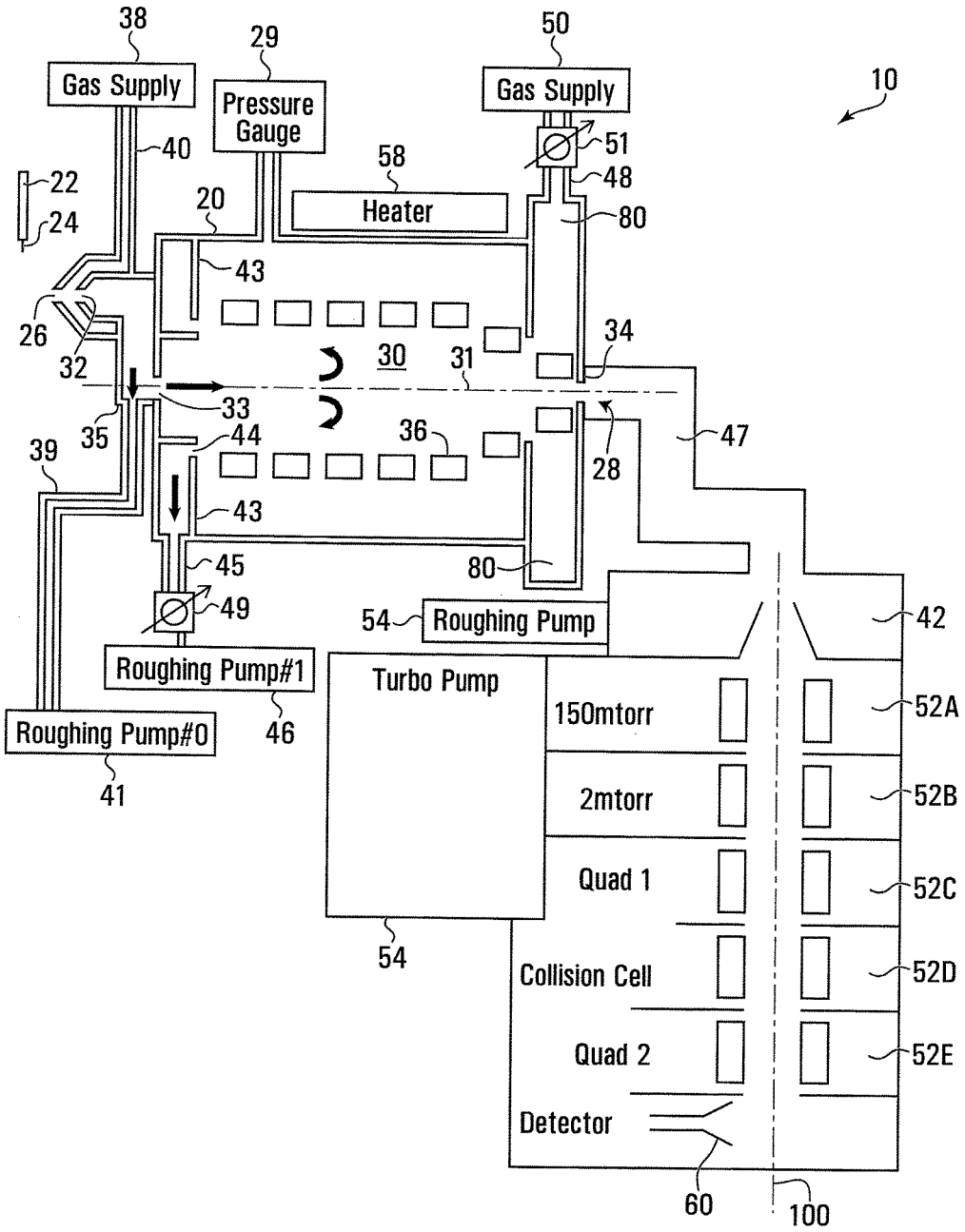
FIG. 1 is a schematic block diagram of a mass analyser, including a mass analyser interface, exemplary of an embodiment of the present invention.

FIG. 1 illustrates a mass analyser 10, including a mass analyser interface 20, exemplary of an embodiment of the present invention.

Mass analyser interface 20 guides analyte particles from a source 22 of analyte particles. In the analyser 10, the analyte source provides ionized solvated analyte, and may for example take the form of an electrospray (ES) emitter 24 at a pressure of about one atmosphere (1 atm=760 torr). Interface 20 guides the solvated analyte from an inlet/exit opening 26 to a pressure less than about 4 torr, to produce desolvated ionized analyte at an outlet 28, and ultimately to the remainder of mass analyser 10.

Mass analyser 10 further includes conventional downstream mass analysis stages, including for example guide stages 52*a*-52*e* to guide ionized particles along a guide axis 100. Stages 52*a*-52*e* may include mass quadrupole filter stages 52*c* and 52*e*, and collision cell 52*d*, all leading ionized particles to a detector 66. One or more pump(s) 54 gradually reduce the pressure from stage to stage within stages 52*a*-52*e*.

Mass analyser interface 20 includes a desolvation chamber 30 having an inlet aperture 33 defining inlet for receiving solvated analyte particles and providing an outlet aperture 34 defining outlet 28 to a second chamber 42. A low pressure interface 35 receives solvated ions fed to inlet aperture 33 at opening 26 of sampling inlet 32, for example from ES emitter 24 that ionizes the solvated analyte particles. An example low pressure interface 35 is, for example, disclosed in U.S. Pat. No. 7,405,398, the contents of which are hereby incorporated by reference. Downstream chamber 42 may be in communication with desolvation chamber 30 directly, or indirectly, for example, by way of conduit 47.

A DC voltage source (not shown) maintains a potential difference between source 22 and sampling inlet 32 to attract ions from source 22 to sampling inlet 32 of interface 35. Analyte source 22 is typically at about atmospheric pressure (e.g. 760 torr). In alternate embodiments, pressure at source 22 could range from 1 atm to 10 atm or higher. Similarly, source 22 is depicted as a single ES emitter 24, but alternatives are possible. For example, an array of ES emitters each associated with its own separate inlet aperture (like sampling inlet 32) is possible. Likewise, although ES emitter 24 is oriented at 90° to a central axis 31 of chamber 30, it could similarly be oriented at another angle (e.g. parallel or otherwise) to this axis. Further, as will become apparent, in other embodiments provided solvated analyte need not be ionized prior to entering interface 35 or chamber 30, but may instead be ionized within interface 35 or chamber 30.

As disclosed in U.S. Pat. No. 7,405,398, interface 35 may entrain analyte in a gas, and provide a tortuous path between sampling inlet 32 and aperture 33, to assist in the liberation of analyte ions therein. Further, the outlet of interface 35 may provide a substantially laminar flow of gas and entrained analyte particles. Optionally, interface 35 may include a heater (not shown) and/or one or more ionizers for heating gas and analyte, and ionizing analyte in interface 35.

In the depicted embodiment, interface 35 is a split-flow interface with gas provided by a supply 38 leaving interface 35 through inlet/exit opening 26 and conduit 39 to roughing pump 41. As will become apparent, interface 35 may be replaced with a direct flow interface, in which substantially all gas entering the interface will exit into chamber 30. As well, inlet/exit opening 26 is aligned with sampling inlet 32, but need not be so located. Opening 26 is spaced from sampling inlet 32 by about 3 mm.

Desolvation chamber 30 may be formed from a generally cylindrical casing, extending along an axis 31. The casing has inlet aperture 33 at one end and outlet aperture 34 at the second opposing end, formed therein. An annular shroud 43 encircles inlet aperture 33, interior to chamber 30. Other geometries are of course possible.

Chamber 30 is typically formed from a heat conductive material, such as metal, and may optionally be heated, by a heater 58. Heater 58 may be configured to heat the inner cylindrical wall of chamber 30 to more than 100 C (e.g. 300 C or higher). Sampling inlet and outlet aperture 32 and 34 may be circular, or any other suitable shape. Inlet aperture 32 may alternatively, or additionally, take the form of a cylindrical or conical tube (not shown) or flat plate that may optionally be heated.

Gas flow within chamber 30 is influenced principally by the flow through sampling inlet 32 and outlet aperture 34, and the introduction of gases through ports 40 and 48, and the evacuation of gases through evacuation port 44, as detailed below. Flow through sampling inlet 32 is largely independent of the flow from port 40 to conduit 39, as this flow is set to be so low—and the opening 26 is large—that the pressure upstream of sampling inlet 32 is constant at about atmosphere (1 atm).

The pressure within chamber 30 may be measured by a pressure gauge 29, in flow communication with the interior chamber 30. The flow of gases through ports 44 and 48 may be electronically controlled, for example using feedback control, as described below.

Gas introduced proximate sampling inlet 32 through port 40 may be introduced into chamber 30 by way of interface 35, effectively positioned upstream of inlet aperture 33.

Gas injection port 48 injects a drying gas from a gas source 50, by way of a gas flow controller 51, into chamber 30 proximate outlet aperture 34, and is located on the cylindrical wall of chamber 30, axially proximate outlet aperture 34. Typical gas types from source 50 are again air or nitrogen—clean and dry. An annular manifold 80, located exterior to chamber 30 may ensure gas entering through port 48 enters chamber 30 uniformly around axis 31, with a flow generally toward axis 31. Manifold 80 may have evenly spaced openings on its inner wall to ensure even distribution of gas from flow controller 51. An inline heater (not shown) may additionally heat gas from gas source 50, prior to the gas entering chamber 30.

In general, forces on desolvated ions and charged droplets are different in a viscous flow and in an electric field. For the same flow and electric field, droplets experience the force of viscous flow more than that of electric fields, and vice-versa for desolvated ions. As such, gas injected through gas injection port 48 provides a counter flow that maintains droplets within chamber 30, while allowing desolvated ions to travel to outlet aperture 34 and thus aids in desolvation. The average axial electric field and counter flow in chamber 30 may be adjusted to enable desolvated ions to travel to outlet aperture 34 in chamber 30, but prevent droplets from so travelling.

The length of the desolvation chamber may thus be chosen to be inversely proportional to ion transit time and can be selected to allow a sufficient number of energy transferring collisions for effective desolvation, for a given temperature, pressure and counter flow. The pressure and temperature can be selected to produce a number density and heat effect sufficient for desolvation while also optimizing the effect of DC and RF confining electric fields.

In an embodiment, desolvation chamber 30 may be about 20 cm in length and 8 cm in diameter, with sampling inlet 32 of interface 35 having a diameter of about 0.5 mm. The typical diameter of inlet aperture 33 may range from about 4 mm to 8 mm, providing minimal flow impedance between sampling inlet 32 and inlet aperture 33. Depending on the desired gas flow through outlet aperture 34, the diameter of outlet aperture 34 can typically range from 1 mm to 5 mm.

Evacuation port 44 for chamber 30 is shown terminating in an annular port extending through an outer cylindrical wall of chamber 30, in close axial proximity to inlet aperture 33. Evacuation port 44, may extend from, or be part of an evacuation conduit 45 that extends from the interior of chamber 30, proximate its central axis to roughing pump 46. Evacuation port 44 (like typical roughing pump ports) may be a series of apertures, but in general, may be reasonably symmetric about and proximate the central axis of chamber 30. In this way, the flow via port 44 from chamber 30 will be flowing roughly parallel to the central axis 31 of chamber 30.

Roughing pump 46 evacuates gases from chamber 30 through evacuation port 44, and thereby regulates the pressure in chamber 30. Roughing pump 46 may be adjustable, so that its flow rate may be adjusted and electronically controlled. Roughing pump 46 may, for example, be a variable frequency pump.

Optionally an adjustable flow restrictor 49 with pressure sensors immediate upstream and downstream of it, may be placed in conduit 45 between roughing pump 46 and chamber 30 to maintain a desired dry gas flow in chamber 30. Again, flow restrictor 49 could be electronically controlled.

Annular wall 43 on the interior of chamber 30 further shape the direction of flow of gases leaving chamber 30 through port 44.

A multi-polar (e.g. quadrupolar, hexapolar, octopolar, etc) multi-stage RF ion guide 36 is disposed in desolvation chamber 30. RF ion guides are known to those of ordinary skill. A possible ion guide 36 is for example disclosed in U.S. Pat. No. 7,932,488, the contents of which are hereby incorporated by reference. Ion guide 36 will typically be low capacitance in order to allow application of a voltage from a voltage source (not shown) at high RF frequencies and voltages, e.g., 2 MHz at 1 $kV_{pp}$. In addition, ion guide 36 will typically create a large average axial electric field: for example, in FIG. 1, a 5 kV electrostatic drop from one end of ion guide 36 of length 10 cm and constant interior diameter and equally spaced stages, may produce a 500 V/cm field. Different geometries and voltages on ion guide 36 could be used to achieve a different field pattern. For example, a cone section of ion guide 36 could generate a hemispherical electric field that has an electric field strength that rises rapidly and focuses ions toward outlet aperture 34 as ions proceed along the cone section of ion guide 36. Average electric fields in excess of 5000 V/cm may thus be possible. Alternatively, a voltage pulsed ion guide may be employed, to generate electrodynamic fields, having similar average axial fields. FIG. 1 illustrates an example shape for ion guide 36. Other shapes are of course possible, an ion guide cone with an inner angle usually ranging from 5° to more than 90° is possible; or a non-conical design may be possible. In addition, ion guide 36 shown in FIG. 1, could be configured to as a ring ion guide, as known to those of ordinary skill. As well, the axial field could be produced otherwise without use of an ion guide or ring ion guide.

A second chamber 42 is in flow communication with the desolvation chamber 30, by way of outlet aperture 34 connecting the desolvation chamber 30 to the second chamber 42. Chamber 42 is shown to principally transport analyte, but chamber 42 could further provide ion mobility selection, as for example discussed in "Ion Mobility-Mass Spectrometry", JOURNAL OF MASS SPECTROMETRY, J. Mass Spectrom. 2008; 43: 1-22.

A conduit 47 connects outlet aperture 34 to the second chamber 42 and the remainder of mass analyser 10. Example conduit 47 introduces several 90° bends into the flow of analyte, however, the central axis of chamber 30 could be located co-axial with guide axis 100. Of note, the axis of downstream gas flow from inlet aperture 33 to outlet aperture 34 of desolvation chamber 30 is different than the guide axis 100 through guide stages 52. Conduit 47 could, however, be straight or eliminated entirely The mass analyser downstream of desolvation chamber 30 need not be quadrupole based as shown, but may include any mass selective device.

In operation, pressure within chamber 30 may be maintained below 1 atm—for example at about 76 torr (or 1/10 atm), but could easily be chosen to range from 1/100 atm to 1 atm. To maintain a fixed pressure in chamber 30 as measured by pressure gauge 29 while accommodating different dry gas flows from flow controller 51, the flow rate of roughing pump 46 may be adjusted, by way of a controller or otherwise.

As noted, the pressure at source 22 is typically at about atmosphere. Analyte particles are solvated at ES emitter 24. Solvated ions and charged liquid droplets from source 22 are drawn to sampling inlet 32 by electric fields. The flow through sampling inlet 32 further transports the mixture through inlet aperture 33. Ion guide 36 contains the ionized particles proximate axis 31, and provides an axial electric field to urge ions from inlet aperture 33 to outlet aperture 34 generally along axis 31.

The axial electric field extends throughout the length of chamber 30, to urge charged particles from inlet aperture 33 to outlet aperture 34.

Gas flow introduced from gas source 38 through interface 35 splits into two flow portions: one portion flows through opening 26—acting as an exit—opposing the flow of charged droplets from source 22/ES emitter 24, while the other portion flows through sampling inlet 32 due to the pressure difference between the region of source 22 and chamber 30—with the pressure at sampling inlet 32 and inlet aperture 33 being marginally above the pressure in chamber 30. The portion that flows through sampling inlet 32 and ultimately into chamber 30 entrains charged droplets and transports them through inlet aperture 33 and toward outlet aperture 34.

The temperature of the gas flow from source 38 and the temperature of the analyte path defined by interface 35 assist in determining the degree of ES droplet desolvation through inlet aperture 33. Typical gas type from source 38 is clean and dry air or nitrogen. The gas pressure from gas source 38 may be adjusted to provide sufficient flow.

As shown approximately by the solid arrows, the flow of charged droplets through aperture 33 slows, expands, reverses direction, and folds back toward aperture(s) 44 leading to roughing pump 46. This pumping design is intended to slow the velocity of droplets from source 22, allowing the droplet time to absorb heat from the surrounding hot gas, as well as absorbing the black body radiation from the heated walls of chamber 30, resulting in desolvated ions.

Adjustable flow restrictor 49 can also be adjusted to ensure a reasonably constant gas flux through roughing pump 46, thereby adjusting residence time of entrained droplets within chamber 30. Without roughing pump 46—or other pumping system—all gas entering chamber 30 through inlet aperture 33 will exit through outlet aperture 34. If this gas containing droplets with or without high salt and protein content (and the like) enters outlet aperture 34, the droplets alone can cause electrical discharge in chamber 42, or conduit 47 leading thereto (or subsequent lower pressure regions—e.g.), and the salt and protein can be deposited on downstream components of mass analyser 10, causing sensitivity degradation.

Proximate outlet 34, gas flow into chamber 30 through gas injection port 48 from gas source 50 splits into two flows: one portion—a counter flow that flows away from outlet aperture 34 opposing the flow of charged droplets emanating from inlet aperture 33—and another portion that flows in the direction of outlet aperture 34, caused by the pressure difference between chamber 30 and conduit 47. The counter flow further slows and desolvates the downstream flow of solvated ionized particles entrained therein, as the solvated ionized particles travel through the desolvation chamber 30 from inlet aperture 33 toward outlet aperture 34.

The flow toward outlet aperture 34 entrains now desolvated ions and transports them through outlet aperture 34 into conduit 47 and onto chamber 42. The temperature of the counter gas flow from source 50 greatly determines the degree of ES droplet desolvation. For example, a temperature of 200° C. or higher may be used.

In typical operation, gas flows through sampling inlet 32 from atmosphere through aperture 33 into chamber 30 at about 0.1 atm, and subsequently through aperture 34 into a conduit 47 at roughly 0.01 atm. With no drying gas flow from gas flow controller 51 and no flow through aperture 44, a typical inlet aperture of 0.5 mm diameter requires an outlet aperture 34 diameter of 1.6 mm, i.e., the gas flux of about 36 atm-cc/s flows through both apertures. Adding drying gas flow from flow controller 51 will increase the pressure in chamber 30 from 0.1 atm, and therefore the pumping speed through aperture 44 can be increased—usually by increasing the frequency of the roughing pump 46—to maintain the pressure in chamber 30 at 0.1 atm.

Conveniently, outlet aperture 34 feeding the remainder of mass spectrometer 10 is larger than a typical inlet aperture at or above atmospheric pressure found in conventional mass spectrometers. That is, in conventional mass spectrometers, desolvated ions are provided through an aperture at atmospheric pressure through a sampling orifice. The typical sampling orifice is, for example, about 0.5 mm in diameter.

In interface 20, solvated ions enter desolvation chamber 30 and desolvate therein. Droplets remain, on average, resident in chamber for a longer time due to the counter flow introduced through gas injection port 48. Desolvated ions then exit at lower pressure (e.g. at 1/10th atmospheric pressure) through a outlet orifice 34 having a 1.6 mm diameter. Provided the desolvated ion densities are reasonably similar to those of a conventional mass spectrometer, and are extracted at a similar velocity, the ion flux through outlet aperture 34 in interface 20 will be correspondingly larger than the usual ion flux through a conventional sampling orifice. For example, if the area of outlet aperture 34 is ten times larger than a conventional sampling orifice, the ion flow will increase by a factor of ten, as will the sensitivity.

Although inlet aperture 33 is shown on axis 31 of chamber 30, it could be located off-axis. In addition, although the direction of flow through sampling inlet 32 is shown as parallel axis 31, alternatives are also possible. Although not shown, reactive gases may also be introduced into chamber 30 are also possible for ion-gas reaction manipulation. Likewise, although source 22 has been described as an ES emitter, ions drawn toward sampling inlet 32 need not originate from an ES emitter: any approximately atmospheric ion source that produces ions will suffice.

Figure 2:
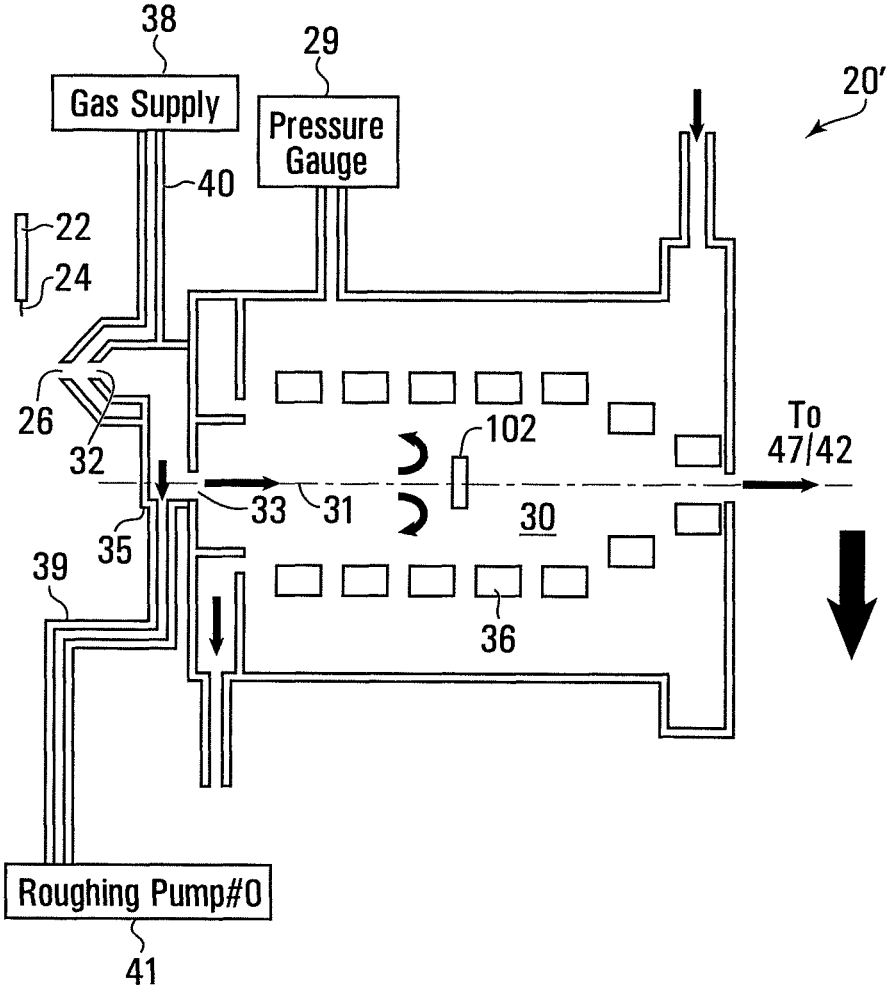
FIGS. 2-8 are schematic block diagrams of further mass analyser interfaces, exemplary of embodiments of the present invention.

In an alternate embodiment illustrated in FIG. 2, a mass analyser interface 20' is depicted. Mass analyser interface 20' is generally the same as mass analyser interface 20 (FIG. 1) but also includes a jet disrupter 102, located on the interior of chamber 30, proximate its center. Jet disrupter 102 may be used to further desolvate the largest droplets in the droplet mixture entering through sampling inlet 32. Typical jet disruptors 102 disturb the incoming jet flow by their physical presence and an applied voltage. An example jet disruptor 102 may, for example, take the form of a 1 mm thick, 5 mm cylindrical disc, or a 5 mm sphere. Example jet disruptors are detailed in U.S. Pat. No. 7,671,344.

Figure 3:
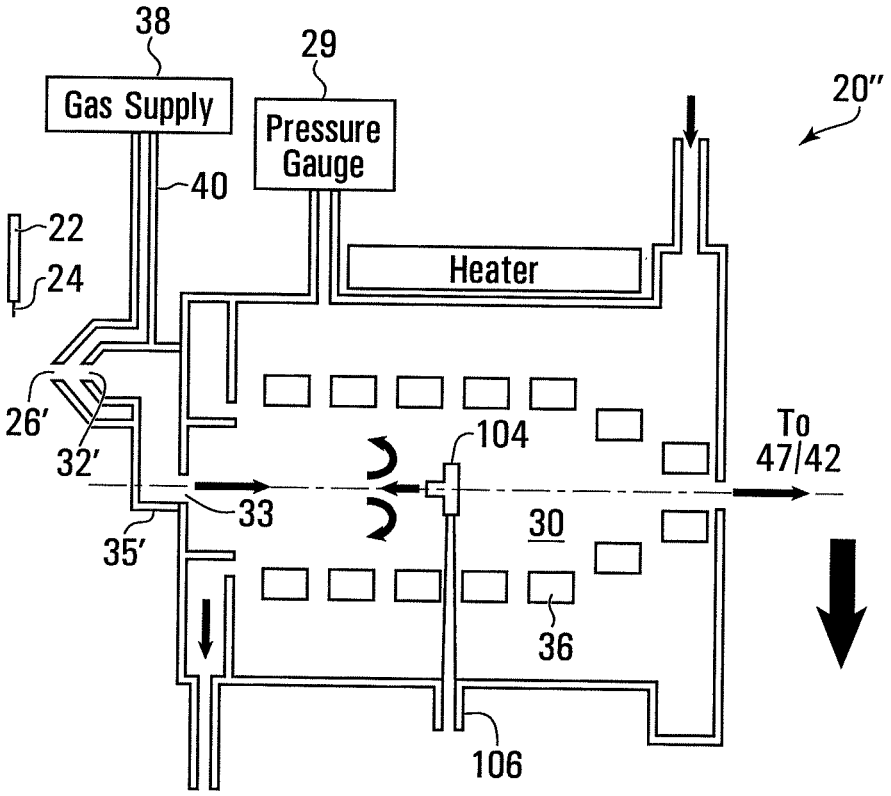

In another alternate embodiment illustrated in FIG. 3, a mass analyser interface 20" is depicted. Mass analyser interface 20" is generally the same as mass analyser interface 20' (FIG. 2), except that the jet disrupter 104 provides a gas flow component opposing the flow through inlet sampling inlet 32', along axis 31, and that interface 35' is unlike interface 35, in that interface 35' is not a split flow interface, but instead is a direct flow interface. Gas provided by gas supply 38 primarily exits interface 35' into desolvation chamber 30 through inlet aperture 33'. In this case, jet disruptor 104 can affect the incoming jet(s) from sampling inlet 32' by gas flow from another source, provided to jet disruptor 104 as well as its physical and electrical characteristics. As required, a conduit 106 in flow communication with jet disruptor 104 may extend from the exterior of chamber 30' to a gas source (now shown). The gas pressure from the disruptor 104 is relative to the pressure in chamber 30, sufficient to create the counter flow. For example, flow through disruptor 104 may be about one half the flow through sampling inlet 32'.

Figure 4:
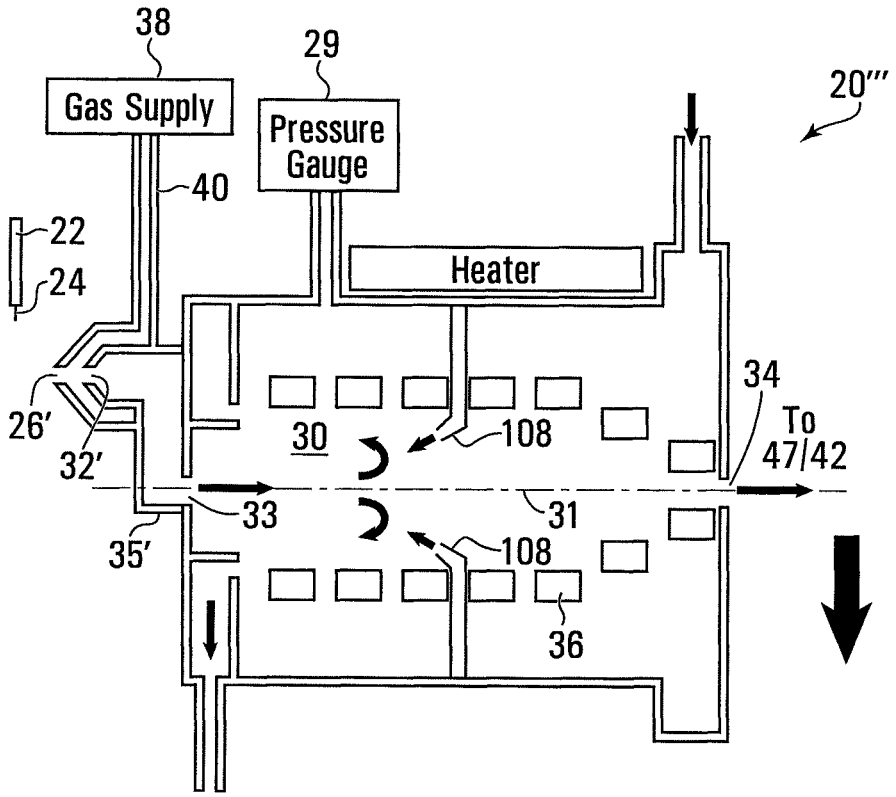

In a further alternate embodiment illustrated in FIG. 4, a mass analyser interface 20''' is depicted. Mass analyser interface 20''' is generally the same as mass analyser interface 20" (FIG. 3), except that two gas jet disrupters 108 are used. In this embodiment, the two gas jet disrupters 108 are on either side of the central axis 31 of chamber 30. The gas flow from these two gas jet disruptors 108 performs the principal function of jet disruption from sampling inlet 32'. Again, a gas source (not shown) may feed jet disruptors 108. Although two gas jet disruptors are shown at 180°, a multiplicity of such disruptors, such as four equally spaced at 90° are possible. Jet disruptors 108 may be located at chosen locations within chamber 30, and may be located in/along the flow from sampling inlet 32' to outlet aperture 34, for example along axis 31. Some may likewise be located off axis, away from the downstream flow and central axis 31.

Figure 5:
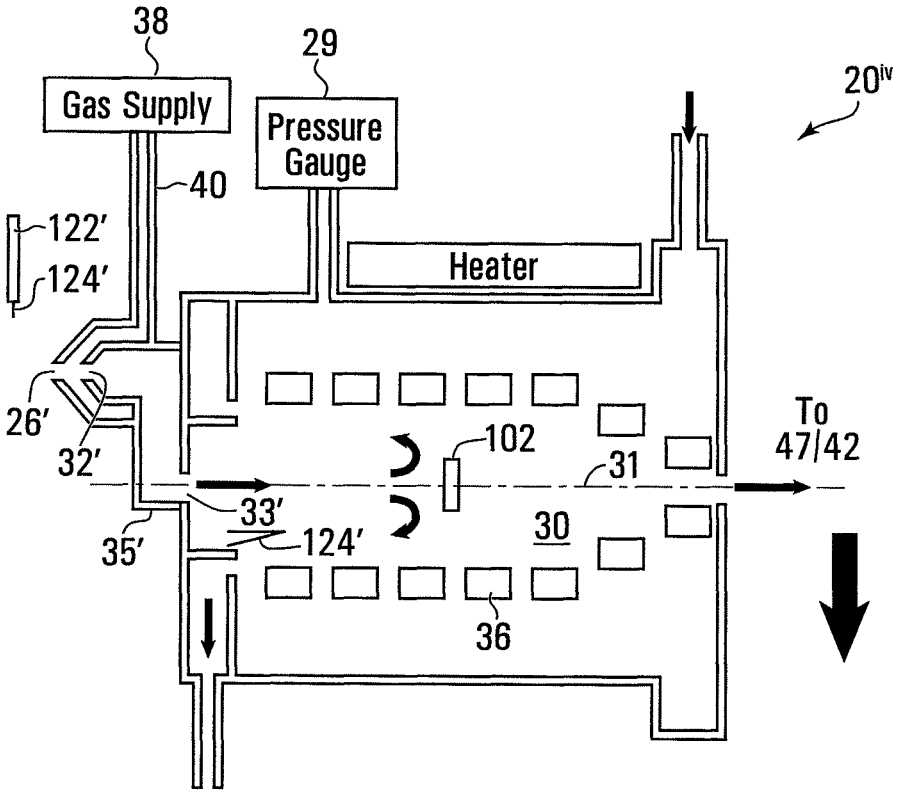

In an alternate embodiment illustrated in FIG. 5, a mass analyser interface 20$^{(iv)}$ is similar to mass analyser 20''' of FIG. 4 except that ES emitter 24 has been replaced with a sprayer 122'. Sprayer 122' volatilizes liquid analyte at atmospheric pressure by, for example by mixing heated, eluted analyte at relatively high temperatures (e.g. above 400 degrees Celsius) with a high flow rate nebulising gas. Some or all of this aerosol cloud is introduced into chamber 30, at sub-atmospheric pressure. In chamber 30, the aerosol is subjected to a corona discharge by corona emitter 124', as shown. Example sprayers and corona emitter are thus similar to those used in APCI interfaces, but separated from another and operating in different pressure regimes, as will be appreciated by those of ordinary skill. Sprayer 122' is also similar to an ES emitter without an electric field at the tip of the liquid tube: that is, it nebulizes a flowing liquid to create droplets and solvated molecules. In this configuration, solvated analyte molecules and droplets from sprayer 122' are entrained within gas flowing through sampling inlet 32'. Again, these solvated analyte molecules and droplets in chamber 30 desolvate due to the counter flow of dry gas and the elevated temperature of heated chamber 30, and are chemically ionized by reagent ions originating from the corona emitter 124' within chamber 30, at pressures less than 1 atm. As such, this configuration provides a sub-atmospheric pressure chemical ionization source. As droplets from sprayer 122' are not charged, they will not be electrically attracted to sampling inlet 32. Instead, droplets are directed to aperture 32, and gas flow through sampling inlet 32' will entrain such droplets and guide them to the interior of chamber 30.

Although not shown in FIG. 5, further analyte ionization may be provided for in chamber 30—either directly or chemically—such as photo-ionization—could be used within desolvation chamber 30 on its own or in conjunction with an atmospheric ES emitter, or emitters.

Although not shown in the embodiments of FIGS. 1 to 5, it should be understood that an atmospheric ES emitter, or emitters, could be used in conjunction with a sprayer and corona emitter in chamber 30, or sprayers and corona emitters, simultaneously or consecutively.

Figure 6:
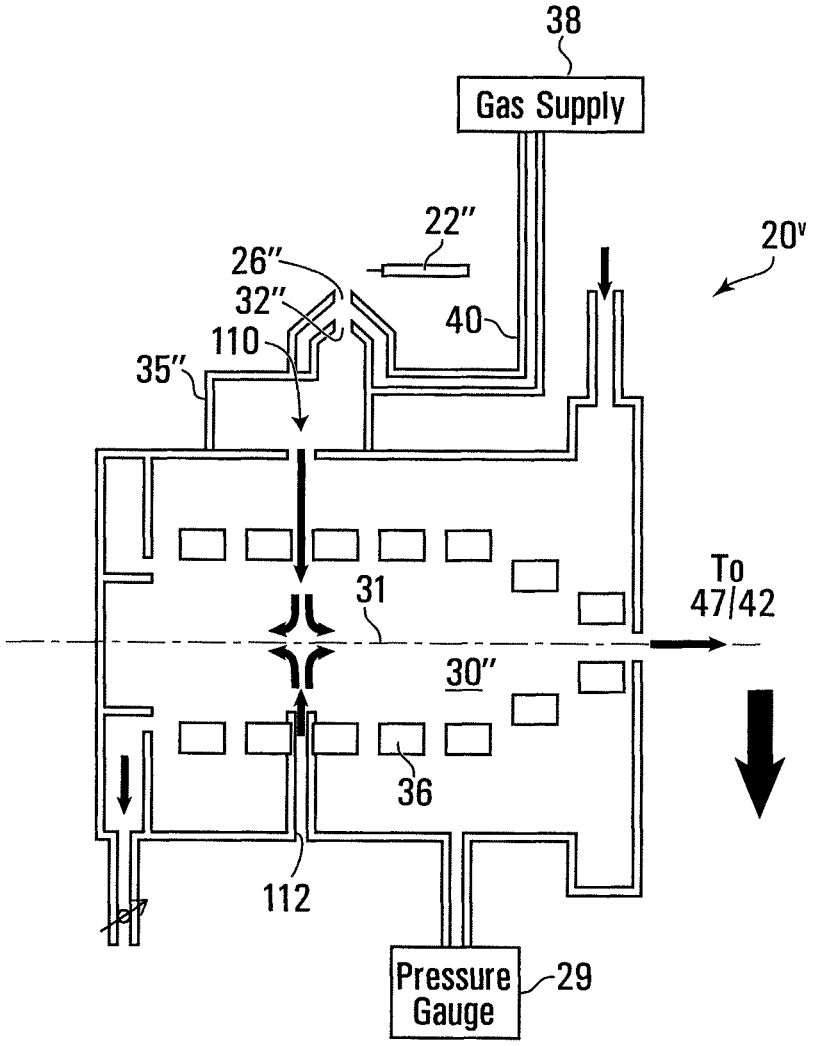

In another alternate embodiment illustrated in FIG. 6, a mass analyser interface 20$^{(v)}$ is depicted. In analyser interface 20$^{(v)}$ an ES emitter 22" provides electrospray droplets to an inlet/exit opening 26" of an interface 35" along the side wall of chamber 30. An inlet aperture 33 (as in FIGS. 1 to 5) in an end wall of chamber 30 may thus be eliminated, and replaced by an inlet aperture 33" on the side wall of chamber 30". A gas jet disruptor flow emanates from gas jet disruptor tube 112 is roughly axially aligned with inlet aperture 110, creating jet disruption opposing the flow from inlet aperture 110, as illustrated. Again, a gas source feeds disruptor tube 112. Of course, additional jet disrupters (not shown), like gas jet disrupter 104 or 108 (FIGS. 3 and 4), may be included in interface 20$^{(v)}$.

Figure 7:
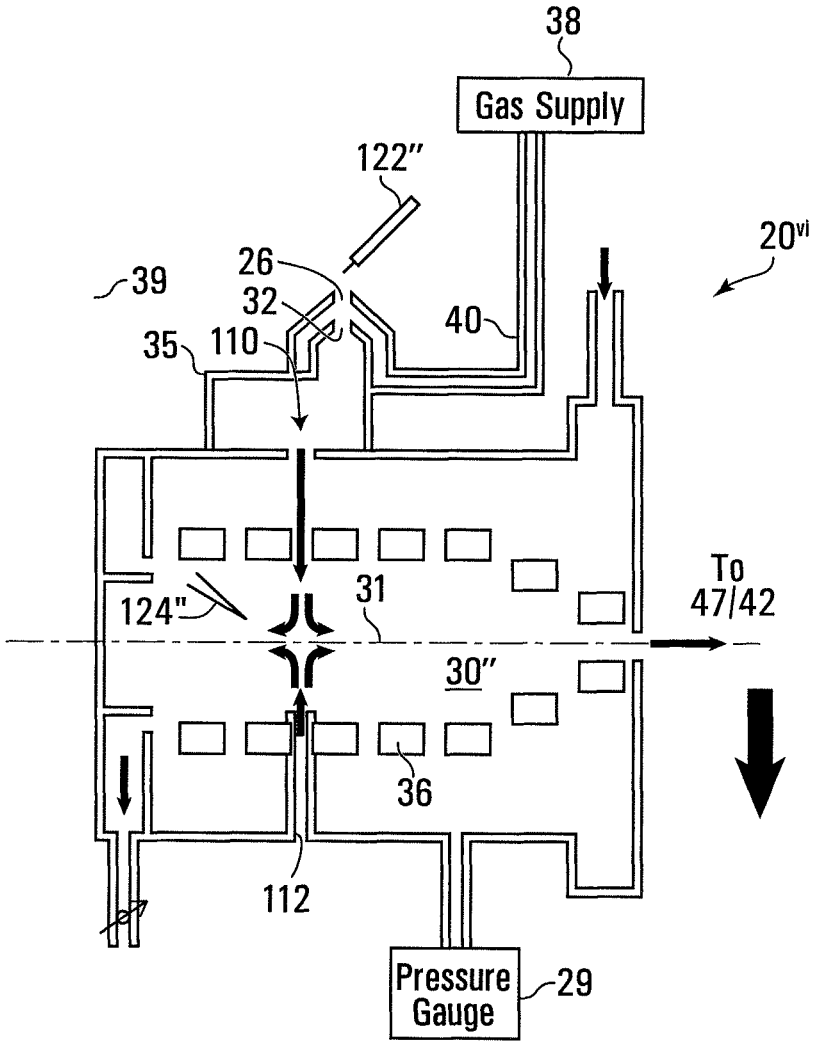

In another alternate embodiment illustrated in FIG. 7, a mass analyser interface 20$^{(vi)}$ that is the same as mass analyser interface 20$^{(v)}$ in FIG. 6 except that the ES emitter 22" has been replaced by a sprayer 122" (like sprayer 122'—FIG. 5) to feed solvated molecules and droplets into chamber 30 through aperture 110. A corona emitter 124" inside chamber 30, proximate aperture 110, completes ionization of the desolvated molecules.

Figure 8:
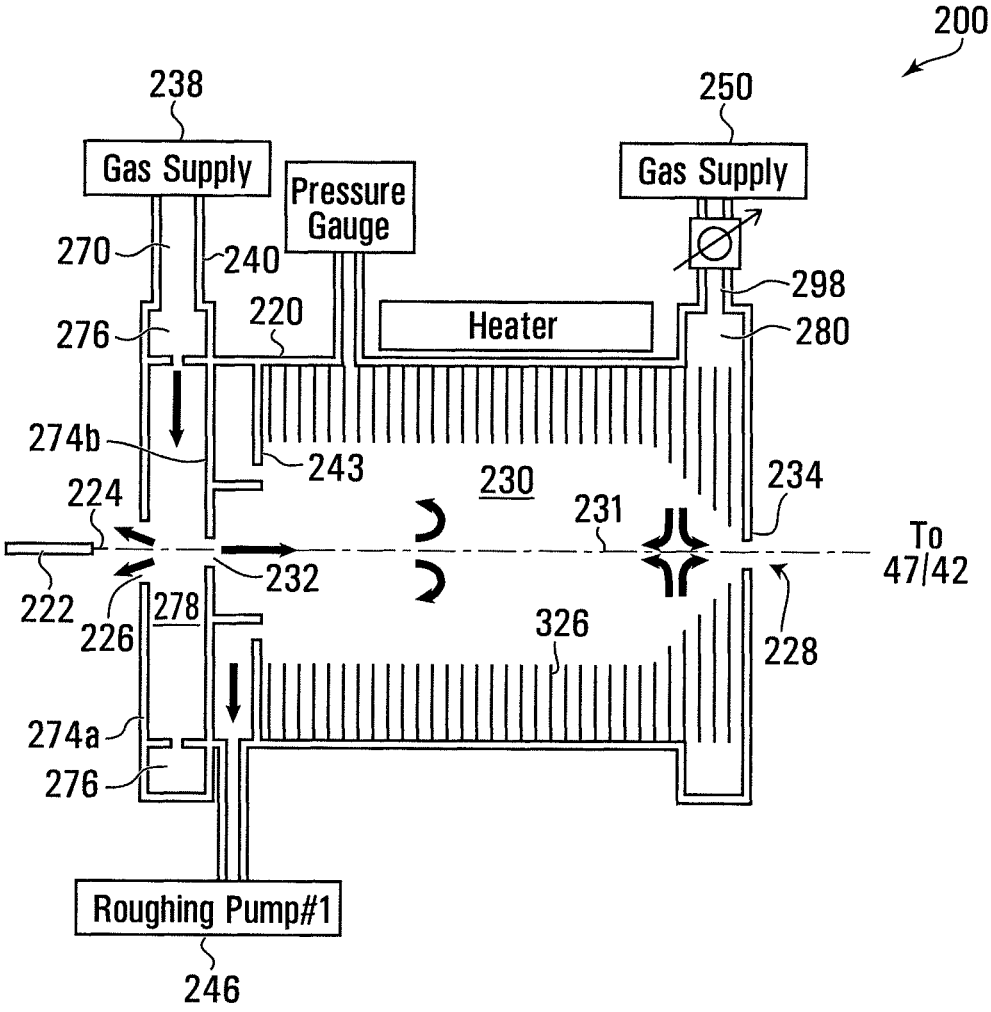

In another alternate embodiment illustrated in FIG. 8, a mass analyser interface 200 that is similar to mass analyser interface 20 in FIG. 1. However, sampling inlet 32 and inlet aperture 33 have combined become a single aperture 232. A gas distribution manifold 270 includes two parallel plates 274*a* and 274*b*. Plate 274*b* defines inlet aperture 232, and plate 274*b* defines opening 226 to gas manifold 270. Opening 226 is aligned with inlet aperture 232 to desolvaton chamber 230. Plates 274*a* and 274*b* are spaced from each other by about 3 mm to define region 278. An annular passage 276 is formed adjacent the region defined by plates 274*a* and 274*b*. The inlet to annular passage 276 extends from the outer wall defining the annular passage 276, and is connected with gas supply 238. Evenly spaced openings on the inner wall of annular passage 276 ensure that gas from supply 238 enters region 278 with a flow toward axis 231, in a generally axial direction of chamber 230. A ring ion guide 326 guides ions within chamber 230 to outlet aperture 234, while a dry gas creating a counter-flow is injected through port 248 from gas supply 250.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. A mass analyser interface, comprising:

a desolvation chamber having a generally cylindrical wall, said desolvation chamber maintained at a pressure between 10 Torr and 700 Torr, and having an inlet for receiving neutral solvated analyte particles from a source of analyte particles, and an outlet aperture for feeding ionized particles from said desolvation chamber to downstream stages of a mass analyzer;

an electric field source, for providing an electric field to urge ionized particles within said desolvation chamber from said inlet toward said outlet aperture, and a containment field to contain said ionized particles about a guide axis, creating a downstream flow of said ionized particles along said guide axis to said downstream stages of said mass analyzer;

a gas injection port to inject an upstream gas proximate said outlet aperture, to provide a counter-flow to said downstream flow at said outlet aperture, to slow solvated ionized particles and neutral particles in said downstream flow more than desolvated ionized particles in said downstream flow as said desolvated ionized particles travel toward said outlet aperture;

at least one evacuation port formed downstream of said inlet on said generally cylindrical wall, to allow injected gas to escape from said desolvation chamber, in a direction away from said guide axis;

an annular shroud, encircling said guide axis and in flow communication with said at least one evacuation port, and said annular shroud having an aperture that guides injected gas to flow from said desolvation chamber into said at least one evacuation port generally parallel to said guide axis;

a pump in flow communication with said at least one evacuation port and said aperture, said pump and said at least one evacuation port configured to guide a counter-flow of said injected gas away from said outlet aperture and toward said inlet, and through said annular shroud and through said at least one evacuation port.

2. The mass analyser interface of claim 1, wherein said source comprises an electrospray emitter, and wherein said solvated analyte particles are said solvated ionized particles.

3. The mass analyser interface of claim 1, further comprising a corona emitter to ionize analyte particles in said desolvation chamber.

4. The mass analyser interface of claim 1, further comprising a photo ionizer in said desolvation chamber.

5. The mass analyser interface of claim 1, further comprising:

a second chamber in flow communication with said desolvation chamber, by way of said outlet aperture connecting said desolvation chamber to said second chamber.

6. The mass analyser interface of claim 1, further comprising a controller to maintain pressure within said desolvation chamber at less than atmospheric pressure.

7. The mass analyser interface of claim 1, further comprising a heater for heating said desolvation chamber.

8. The mass analyser interface of claim 7, wherein said heater heats said desolvation chamber to in excess of 100° C.

9. The mass analyser interface of claim 1, wherein said outlet aperture is located about a central axis of said desolvation chamber.

10. The mass analyser interface of claim 9, wherein said downstream flow is along said central axis of said desolvation chamber.

11. The mass analyser interface of claim 10, wherein said counter-flow is generally opposite to said downstream flow.

12. The mass analyser interface of claim 1, wherein said desolvation chamber is maintained at a pressure of between about 30 torr to about 250 torr.

13. The mass analyser interface of claim 1, further comprising an ion guide in said desolvation chamber.

14. The mass analyser interface of claim 13, wherein said ion guide acts as said electric field source in said desolvation chamber.

15. The mass analyser interface of claim 14, wherein said ion guide comprises a stacked ring ion guide.

16. The mass analyser interface of claim 14 wherein said ion guide comprises a multi-polar ion guide.

17. A mass analyser comprising the mass analyser interface of claim 1, and a plurality of guide stages, downstream of said desolvation chamber.

18. The mass analyser interface of claim 3, wherein said source volatilizes said analyte particles.

19. The mass analyser interface of claim 1, further comprising a flow disruptor in said desolvation chamber along a path of said downstream flow.

20. The mass analyser interface of claim 19, wherein said flow disruptor comprises at least one jet nozzle.

21. The mass analyser interface of claim 19, wherein said flow disruptor comprises at least one jet nozzle that is not along a central axis of said desolvation chamber.

22. The mass analyser interface of claim 2, further comprising a corona emitter in said desolvation chamber to aid in ionizing analyte in said desolvation chamber.

23. A method of providing desolvated ions in a mass analyser, said method comprising:

providing neutral solvated analyte particles from a source of analyte particles into a desolvation chamber having an inlet and an outlet aperture;

maintaining pressure in said desolvation chamber between 10 Torr and 700 Torr;

providing an electric field to contain ionized particles about a guide axis and urge said ionized particles toward said outlet aperture in a downstream flow;

heating said desolvation chamber to aid in desolvation of solvated ionized particles within said desolvation chamber;

injecting an upstream gas proximate said outlet aperture, to provide a counter-flow to said downstream flow at said outlet aperture, to slow said downstream flow and any neutral particles and any solvated particles entrained therein;

evacuating said upstream gas by way of a pump, through an evacuation port formed downstream of said inlet by way of an annular shroud, encircling said guide axis and in flow communication with said evacuation port;

wherein said annular shroud comprises at least one aperture that guides injected gas to flow from said desolvation chamber in a direction generally parallel to said guide axis and wherein said annular shroud guides said injected gas to evacuate from said evacuation port in a direction generally away from said guide axis;

said evacuation port, said annular shroud and said pump configured to guide the flow of said injected gas in a direction generally parallel to said guide axis away from said outlet aperture and toward said inlet, and through said evacuation port;

providing ionized particles from said desolvation chamber to a downstream stage of said mass analyzer by way of said outlet aperture.

24. The method of claim 23, further comprising ionizing analyte within said desolvation chamber.

25. The method of claim 23, further comprises guiding said ionized particles along said guide axis in said desolvation chamber.

26. The method of claim 23, wherein said analyte particles are provided from a source above atmosphere.

27. The method of claim 23, further comprising ionizing at least some desolvated analyte particles in said desolvation chamber by way of at least one of a corona emitter and a photo ionizer.

28. The method of claim 27, further comprising ionizing at least some of said desolvated analyte particles at an electrospray source.

29. The method of claim 28, wherein said ionizing by way of at least one of a corona emitter and a photo ionizer and said ionizing at least some of said desolvated analyte particles at an electrospray source are performed concurrently.

30. The mass analyser interface of claim 1, wherein the ions in the desolvation chamber arise from within the solvated analyte particles.

31. The mass analyser interface of claim 1, wherein said desolvation chamber is maintained at a pressure less than 76 Torr.

32. The mass analyser interface of claim 1, wherein said counter-flow of said injected gas guides charged solvated particles to reverse direction toward said outlet aperture.

* * * * *